US006402474B1

(12) United States Patent
Okuno

(10) Patent No.: US 6,402,474 B1
(45) Date of Patent: Jun. 11, 2002

(54) MOVING TURBINE BLADE APPARATUS

(75) Inventor: Kenichi Okuno, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/640,045

(22) Filed: Aug. 17, 2000

(30) Foreign Application Priority Data

Aug. 18, 1999 (JP) ..... 11-231339

(51) Int. Cl.[7] ..... F01D 1/24
(52) U.S. Cl. ..... 416/190; 416/195
(58) Field of Search ..... 416/190, 189, 416/191, 192, 195, 500

(56) References Cited

U.S. PATENT DOCUMENTS

| | | | | |
|---|---|---|---|---|
| 2,278,041 A | | 3/1942 | Allen | |
| 4,643,645 A | | 2/1987 | Robbins et al. | |
| 5,083,903 A | * | 1/1992 | Erdmann | 416/191 |

FOREIGN PATENT DOCUMENTS

| | | |
|---|---|---|
| FR | 1 374 917 | 11/1963 |
| JP | 3-19882 | 3/1991 |

* cited by examiner

*Primary Examiner*—F. Daniel Lopez
*Assistant Examiner*—James M McAleenan
(74) *Attorney, Agent, or Firm*—Finnegan, Henderson, Farabow, Garrett & Dunner, L.L.P.

(57) ABSTRACT

A moving turbine blade apparatus has a plurality of moving blades (5) adapted to be mounted on a rotor shaft, a plurality of snubber covers (6) formed on outer ends of the moving blades (5), respectively, so as to be arranged successively in a circle having its center on the axis of the rotor shaft, and a plurality of ribs (10) projecting from outer surfaces of the snubber covers (6), respectively, so as to extend in a circle having its center on the axis of the rotor shaft. At least one of the opposite end portions of the rib (10) has a thickness measured in a direction of the axis of the rotor shaft greater than that of a middle portion of the same rib (10). Steam loss attributable to the leakage of steam through gaps around the outer ends of the moving blades (5) is reduced.

9 Claims, 8 Drawing Sheets

MOVING TURBINE BLADE APPARATUS

BACKGROUND OF THE INVENTION

1. Field of the Invention

The present invention relates to a moving turbine blade apparatus and, more particularly, to a moving turbine blade apparatus for a steam turbine to be installed in a power plant.

2. Description of the Related Art

In a thermal power plant or a nuclear power plant, steam generated by a boiler, a heat exchanger or a steam generator is supplied to a steam turbine. The steam turbine converts the thermal energy of steam into mechanical power in rotary motion.

FIG. 8 is a sectional view of a final stage of a general steam turbine. Steam passed moving blades 1 of the front stage of the steam turbine flows through nozzles 4 of the final stage of the steam turbine disposed between an outer ring 2 in a nozzle diaphragm and an inner ring 3 in the nozzle diaphragm and acts on moving blades 5 of the final stage. The steam thus worked is discharged into a condenser. In FIG. 8, indicated as a reference numeral 11 is a turbine shaft.

FIG. 9 is an enlarged perspective view of outer end portions of the moving blades 5 of the final stage. A snubber cover 6 of a shape conforming to the inner surface of the outer ring 2 of the nozzle diaphragm is formed integrally with a tip portion of the moving blade 5. The snubber cover 6 has a front edge covering part 6*a* extending downstream with respect to the flowing direction of steam indicated by the arrow B in FIG. 9 and a rear edge covering part 6*b* extending upstream with respect to the flowing direction of steam. While the turbine is in operation, the rear edge covering part 6*b* of the preceding moving blade 5 and the front edge covering part 6*a* of the following moving blade 5 are in contact with each other so that snubber covers 6 of all the moving blades 5 form a continuous circumferential structure. In FIG. 9, the arrow RV indicates the rotating direction of the turbine rotor.

If the snubber covers 6 of the adjacent moving blades 5 are in contact with each other to restrain the moving blades 5 from distortion while the turbine is not in operation, it is difficult to assemble the turbine rotor. Furthermore, a large restraining moment acts on the moving blades 5 while the turbine is in operation and an excessively high stress is induced in the snubber covers 6. Therefore, the snubber covers 6 are designed such that a gap D is formed between the adjacent snubber covers 6 as shown in FIG. 10A while the turbine is not in operation and the adjacent snubber covers 6 come into contact with each other as shown in FIG. 10B when the moving blades 5 are twisted by force that acts on the moving blades 5 when the turbine rotor rotates. Thus, increase in restraining moment is limited to the least necessary extent for damping effect.

As shown in FIG. 11, a gap Cr is formed inevitably between the snubber covers 6 of the moving blades 5, i.e., a moving side of the turbine, of the final stage and the inner circumference of the outer ring 2 of the nozzle diaphragm, i.e., a stationary side of the turbine. Steam that leaks through the gap Cr does not exercise any work and disturbs the flow of steam that passes effective portions of the moving blades. Accordingly, it is one of important problems that must be solved for the improvement of the performance of a steam turbine to reduce the leakage of steam.

The temperature and pressure of steam supplied to a steam turbine drop gradually as the steam works in the stages of the steam turbine and finally changes into a wet steam containing water droplets. Water droplets produced and grown in steam passages are forced to fly toward the surface of the outer ring 2 of the nozzle diaphragm as indicated by the arrows a in FIG. 12 by centrifugal force that acts thereon as the moving blades turn. Water adhering to the surface of the outer ring 2 of the nozzle diaphragm moves downstream along the same surface. Part of the water is discharged outside the final stage and another part of the water wets the surfaces of the nozzles 4 of the final stage, remains on the trailing edges 4*a* of the nozzles 4 and grows into large water droplets 7. The large water droplets 7 are torn apart and strike against the moving blades 5 of the final stage to erode the moving blades 5. The arrows indicated by dotted lines in FIG. 12 indicate the flow of steam.

Means proposed to reduce steam loss attributable to the leakage of steam by reducing steam leakage attach annular ribs 8 to the inner circumference of the outer ring 2 of the nozzle diaphragm opposite to the tips of the moving blades of the final stage as shown in FIG. 13 or form ribs on the tips of the moving blades of the final stage so as to project toward the inner circumference of the outer ring 2 of the nozzle diaphragm.

In a steam turbine as shown in FIG. 13, the leakage passage of steam is narrowed by the ribs 8. Steam expands while reducing its pressure as steam flows through a narrowed gap Cr' and whirls in expansion chambers 9 dissipating its energy. Consequently, the leakage of steam through the gap Cr' decreases.

However, it is difficult for water to flow outside the stage along the inner circumference of the outer ring 2 of the nozzle diaphragm because the ribs 8 project from the inner circumference of the outer ring 2. Consequently, the amount of moisture contained in steam that flows through the steam passage flowing in the direction of the arrows b increases, water droplets that fly off the trailing edges 4*a* of the nozzles 4 of the final stage increase and thereby the erosion of the moving blades 5 is promoted.

If ribs are formed on the outer end of the largest moving blade 5 provided with the snubber cover 6 so as to project toward the inner circumference of the outer ring 2 of the nozzle diaphragm, the ribs are discontinuous with each other due to the torsion of the outer end of the moving blade 5 by centrifugal force exerted on the moving blade 5 and end portions facing forward in the direction of rotation are eroded. Since the ribs are thin, even a small gap between the adjacent ribs causes erosion.

Although steam loss attributable to the leakage of steam can be reduced by the ribs, the ribs increase possibility that the outer ends of the moving blades touch the stationary parts of the turbine due to the transitional warping of the moving blades during starting and stopping periods, i.e., possibility of rubbing, because the gap between the ribs and the inner circumference of the outer ring 2 of the nozzle diaphragm is small. The thickness of the outer end portion of the moving blade of the final stage, i.e., the largest moving blade, is decreased toward the outer end to reduce centrifugal force and to increase inflow Mach number. Therefore, the torsional vibration of the moving blade is enhanced if the leading or the trailing edge of the moving blade touches a stationary part and a force is exerted on the moving blade. High stress is induced particularly in thin portions of the leading and the trailing edge of the moving blade by torsional vibration, which reduces the reliability of the moving blade remarkably.

The present invention has been made in view of such a problem and it is therefore an object of the present invention to reduce steam loss attributable to the leakage of steam through gaps in the vicinity of the outer ends of the moving blades. Another object of the present invention is to suppress the erosive actions of water droplets on ribs. A third object of the present invention is to suppress the torsional vibration of moving blades.

SUMMARY OF THE INVENTION

A moving turbine blade apparatus according to a first aspect of the present invention includes a plurality of moving blades adapted to be mounted on a rotor shaft; a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft; wherein at least one of opposite end portions of the rib has a thickness measured in a direction of the axis of the rotor shaft greater than a thickness of a middle portion of the same rib measured in the direction of the axis of the rotor shaft.

Since the snubber covers are provided with the ribs on their outer surfaces, respectively, and at least one of the opposite end portions of the rib has a thickness measured in the direction of the axis of the rotor shaft greater than that of a middle portion of the same rib, the corresponding end surfaces of the adjacent ribs can be surely brought into contact with each other when the turbine operates, so that steam loss attributable to the leakage of steam through a steam passage between a stationary part of the turbine and the outer ends of the moving blades can be reduced.

Preferably, the thickness of one of the opposite end portions of the rib measured in the direction of the axis of the rotor shaft is greater than a thickness of an other end portion of the same rib measured in the direction.

When the ribs are thus formed in such dimensions, the corresponding end portions of the adjacent ribs can be surely engaged and one of the engaged end portions of the ribs can be covered with the other, which reduces the eroding effect of water droplets on the ribs.

Preferably, the rib is extended in alignment with a longitudinal center axis of the snubber cover.

When the ribs are thus extended, the growth of torsional vibration of the moving blades can be suppressed even if the leading or the trailing edges of the moving blades should touch the inner circumference of the outer ring of the nozzle diaphragm of the turbine.

A moving turbine blade apparatus according to a second aspect of the present invention includes a plurality of moving blades adapted to be mounted on a rotor shaft; a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft; wherein at least one of a pair of the adjacent ribs has opposite end portions each having a thickness measured in a direction of the axis of the rotor shaft greater than a thickness of a middle portion of the same rib.

When the ribs of the blades are thus formed, the corresponding ends of the adjacent ribs can be surely engaged, so that steam loss attributable to the leakage of steam through a steam passage between a stationary part of the turbine and the outer ends of the moving blades can be reduced.

Preferably, the rib is extended in alignment with a longitudinal center axis of the snubber cover.

When the ribs are thus extended, the growth of torsional vibration of the moving blades can be suppressed even if the leading or the trailing edges of the moving blades should touch the inner circumference of the outer ring of the nozzle diaphragm of the turbine.

A moving turbine blade apparatus according to a third aspect of the present invention includes a plurality of moving blades adapted to be mounted on a rotor shaft; a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft; wherein the ribs of the adjacent moving blades are aligned while the turbine is in operation, and ends of the ribs of the adjacent moving blades are offset with each other while the turbine is not in operation.

When the ribs are thus formed, the corresponding ends of the adjacent ribs can be surely engaged, so that steam loss attributable to the leakage of steam through a steam passage between a stationary part of the turbine and the outer ends of the moving blades can be reduced.

Preferably, the rib is extended in alignment with a longitudinal center axis of the snubber cover.

When the ribs are thus extended, the growth of torsional vibration of the moving blades can be suppressed even if the leading or the trailing edges of the moving blades should touch the inner circumference of the outer ring of the nozzle diaphragm of the turbine.

A turbine moving blade apparatus according to a fourth aspect of the present invention includes a plurality of moving blades adapted to be mounted on a rotor shaft; a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft; wherein respective heights of opposite end portions of the rib is smaller than a height of a middle portion of the same rib.

When the ribs are thus formed, the exertion of external force on the leading and the trailing edges of the moving blades due to rubbing can be avoided and the growth of torsional vibration characteristic of large blades can be avoided.

Preferably, rib is extended in alignment with a longitudinal center axis of the snubber cover.

When the ribs are thus extended, the growth of torsional vibration of the moving blades can be suppressed even if the leading or the trailing edges of the moving blades should touch the inner circumference of the outer ring of the nozzle diaphragm of the turbine.

A moving turbine blade apparatus according to a fifth aspect of the present invention includes a plurality of moving blades adapted to be mounted on a rotor shaft; and a plurality of snubber covers formed on outer ends of the moving blades, respectively, so as to be arranged successively in a circle having its center on an axis of the rotor shaft and each having a front edge portion on a downstream side with respect to a flowing direction of a working fluid, a rear edge portion on an upstream side with respect to the flowing direction of the working fluid and a middle portion between the front edge portion and the rear edge portion; wherein the snubber cover is formed such that a gap between an inner circumference of an outer ring of a nozzle diaphragm of the turbine and the front edge portion of the snubber cover and a gap between the inner circumference of the outer ring of the nozzle diaphragm of the turbine and the rear edge portion of the snubber cover each is greater than a gap between the inner circumference of the outer ring of the nozzle diaphragm of the turbine and the middle portion of the same snubber cover.

When the snubber covers are thus formed, the exertion of external force on the leading and the trailing edges of the moving blades due to rubbing can be avoided and the growth of torsional vibration characteristic of large blades can be avoided.

Preferably, the moving turbine blade apparatus further includes a plurality of ribs projecting from outer surfaces of the snubber covers, respectively, so as to extend in a circle having its center on the axis of the rotor shaft.

DESCRIPTION OF THE PREFERRED EMBODIMENTS

Figure 1:
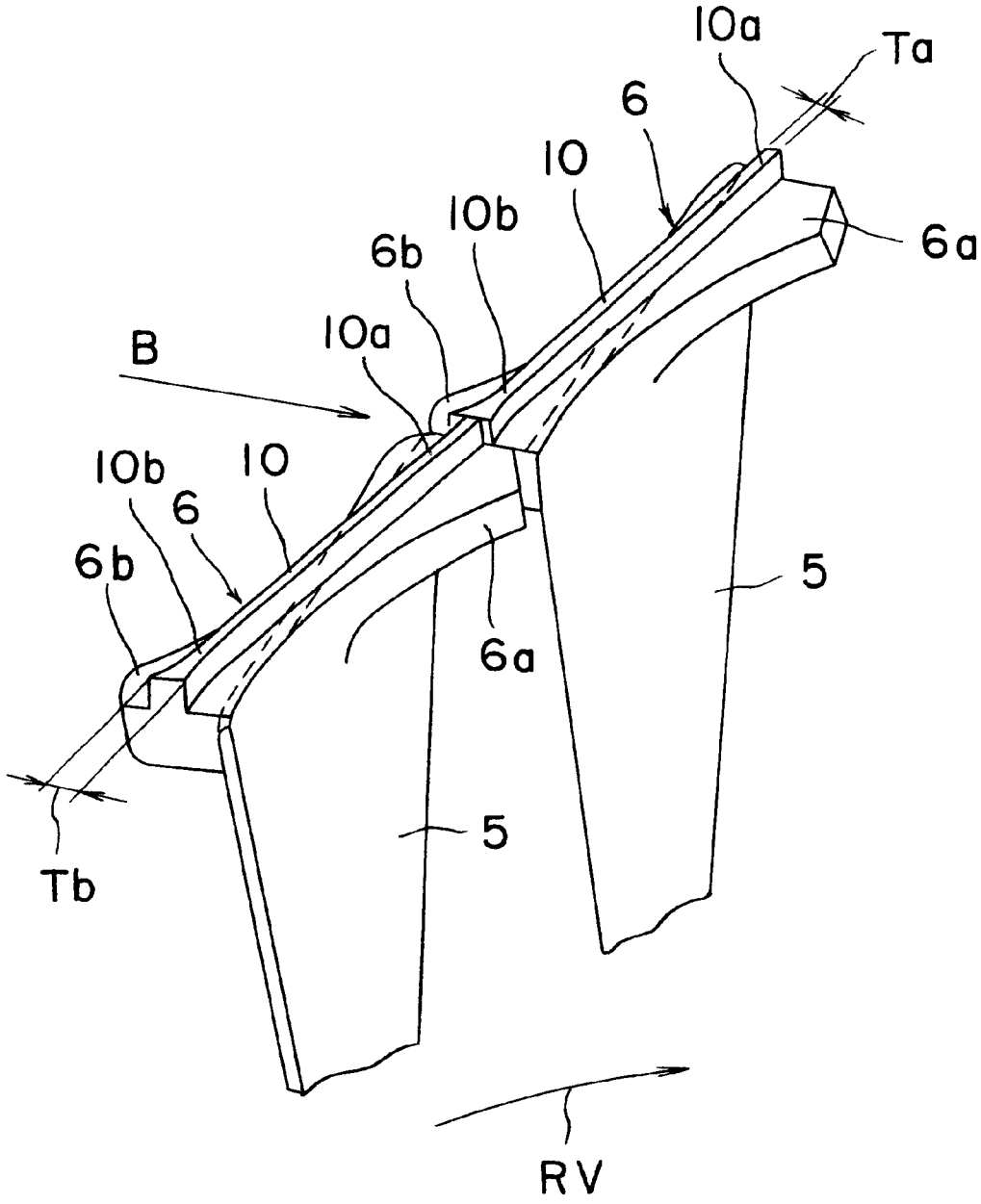
FIG. 1 is an enlarged perspective view of outer end portions of moving blades in a moving turbine blade apparatus in a embodiment according to the present invention.

Preferred embodiments of the present invention will be described with reference to FIGS. 1 to 7, in which parts like or corresponding to those described previously with reference to FIGS. 8 to 13 are denoted by the same reference characters and the description thereof will be omitted.

FIG. 1 is an enlarged perspective view of outer end portions of moving blades in a moving turbine blade apparatus in a first embodiment according to the present invention for the final stage in a turbine. A snubber cover 6 is formed integrally with an outer end portion of a moving blade 5. A rib 10 is formed integrally with the snubber cover 6 on the outer surface of the snubber cover 6 facing the inner circumference of the outer ring 2 of the nozzle diaphragm (FIG. 8) so as to extend along the length of the snubber cover 6, i.e., in a circumferential direction of the steam turbine.

The snubber cover 6 has a front edge portion 6*a* projecting in the flowing direction B of steam and a rear edge portion 6*b* projecting in a direction opposite the flowing direction B. The rib 10 has a front end portion 10*a* on the side of the front edge of the moving blade and a rear end portion 10*b* on the side of the trailing edge of the moving blade. The thickness Tb of the rear end portion 10*b* of the rib 10 is greater than the thickness Ta of the front end portion 10*a* of the rib 10.

Figure 2A:
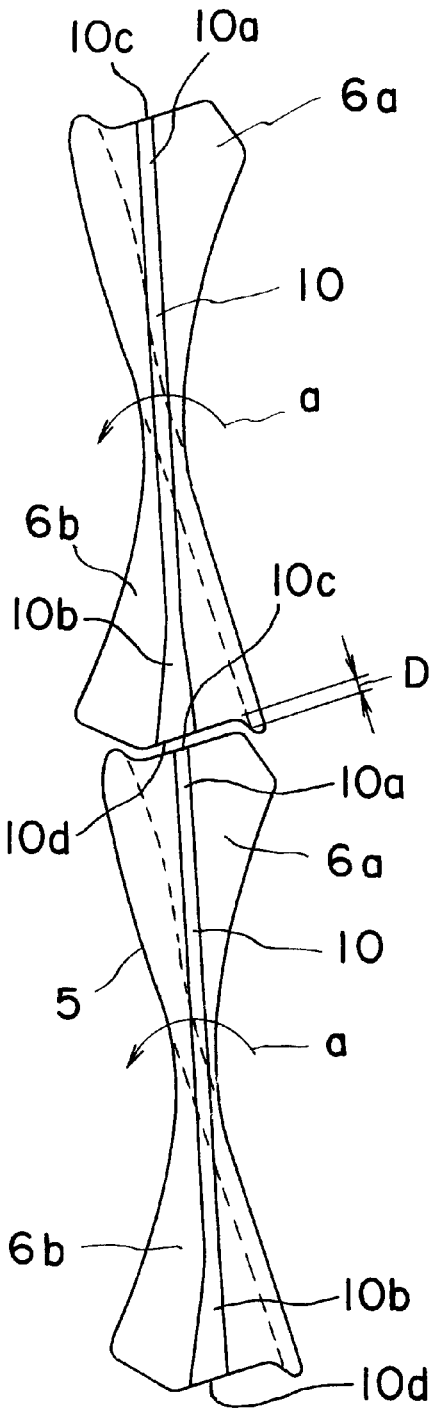
FIG. 2A is a plan view of snubber covers attached to the moving blades of the turbine moving blade apparatus shown in FIG. 1 in a state when the turbine is not in operation.
Figure 2B:
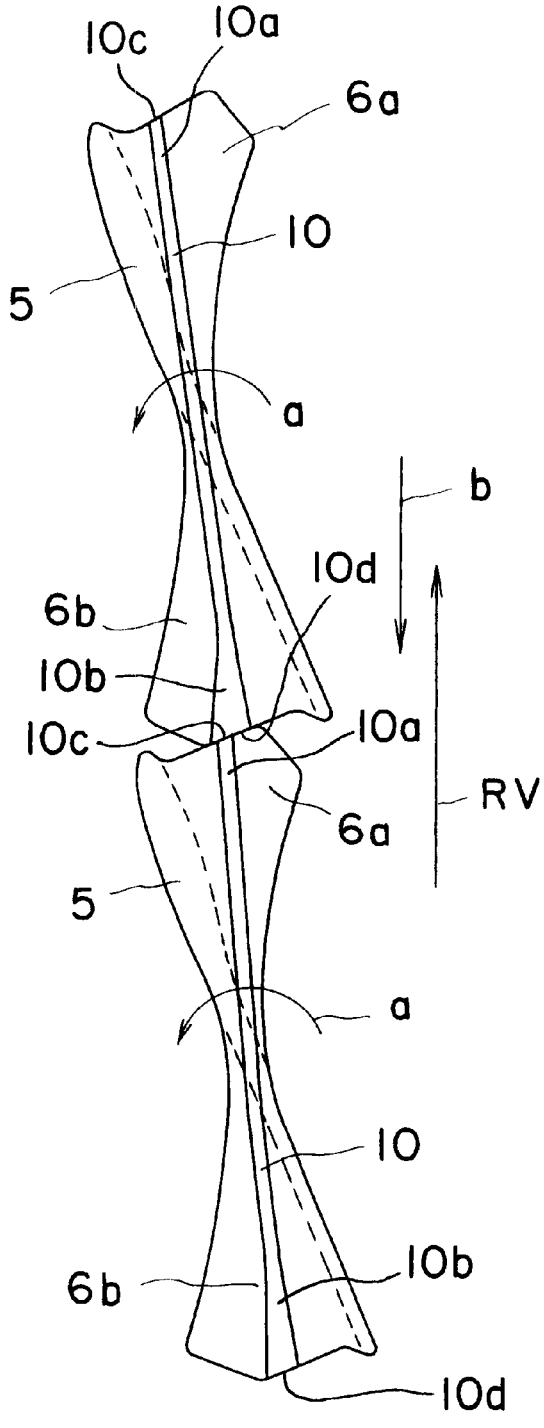
FIG. 2B is a plan view of the snubber covers attached to the moving blades of the moving turbine blade apparatus shown in FIG. 1 in a state when the turbine is in operation.

FIGS. 2A and 2B are plan views of the snubber covers 6 provided with the ribs 10 in a state when the turbine is not in operation and in a state when the turbine is in operation, respectively.

As shown in FIG. 2A, while the turbine is not in operation, a gap D is formed between the end surface of the front end portion 10*a* of the rib 10 (front end surface of the rib) and the end surface of the rear end portion 10*b* of the next rib 10 (rear end surface of the rib) facing the front end portion 10*a*.

As mentioned above, the moving blades 5 are twisted by centrifugal force that acts on the moving blades 5 while the turbine is in operation. The ribs 10 of the adjacent moving blades 5 must become continuous when the moving blades 5 are twisted.

In the present embodiment, the adjacent ribs 10 become continuous as shown in FIG. 2B when the moving blades 5 are twisted in the direction of the arrow a in FIG. 2A. The thickness of the rear end portion 10*b* of the rib 10 on the side of the trailing edge of the moving blade is greater than the thickness Ta of the front end portion 10*a* of the rib 10 on the side of the front edge of the moving blade. Therefore, the end surface 10*c* of the front end portion 10*a* of the following rib 10, i.e., the front end surface 10*c* of the following rib 10, and the end surface 10*d* of the rear end portion 10*b* of the preceding rib 10, i.e., the rear end surface 10*d* of the preceding rib 10, can be surely engaged. The front end surface 10*c* can be entirely covered with the rear end surface 10*d*. Thus, the front end surface 10*c* of the rib 10 facing opposite to the flowing direction of water dorps indicated by the arrow b is not exposed to water droplets.

Consequently, the rib 10 formed on the outer surface of the snubber cover 6 formed integrally with each moving blade 5 reduces steam loss attributable to the leakage of steam. Water droplets produced by the condensation of steam do not strike against the front end surfaces 10*c* of the ribs 10 facing opposite to the flowing direction of water droplets indicated by the arrow b, and the erosion of the ribs 10 by water droplets can be suppressed.

Figure 3A:
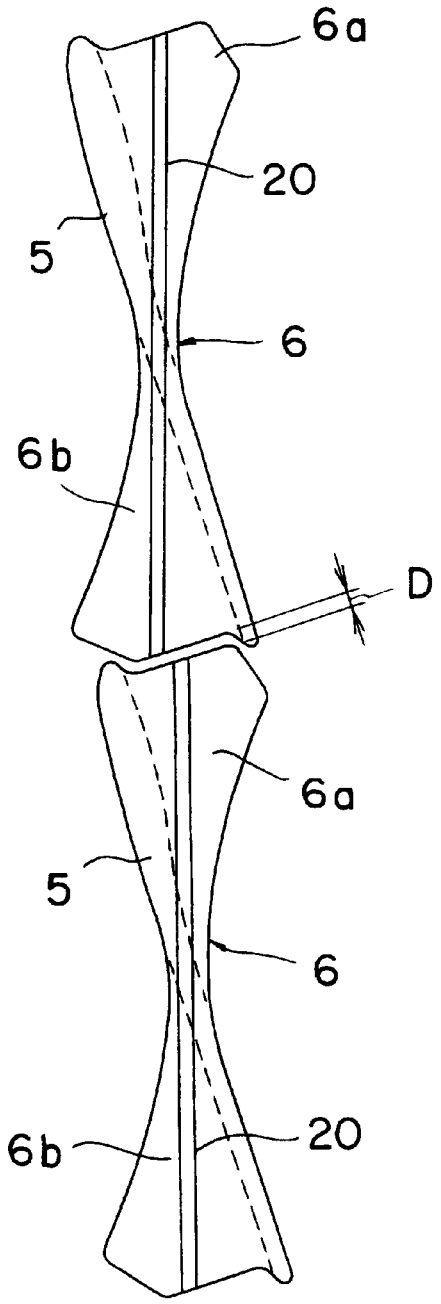
FIG. 3A is a plan view of snubber covers attached to moving blades of a moving turbine blade apparatus in another embodiment according to the present invention in a state when the turbine is not in operation.
Figure 3B:
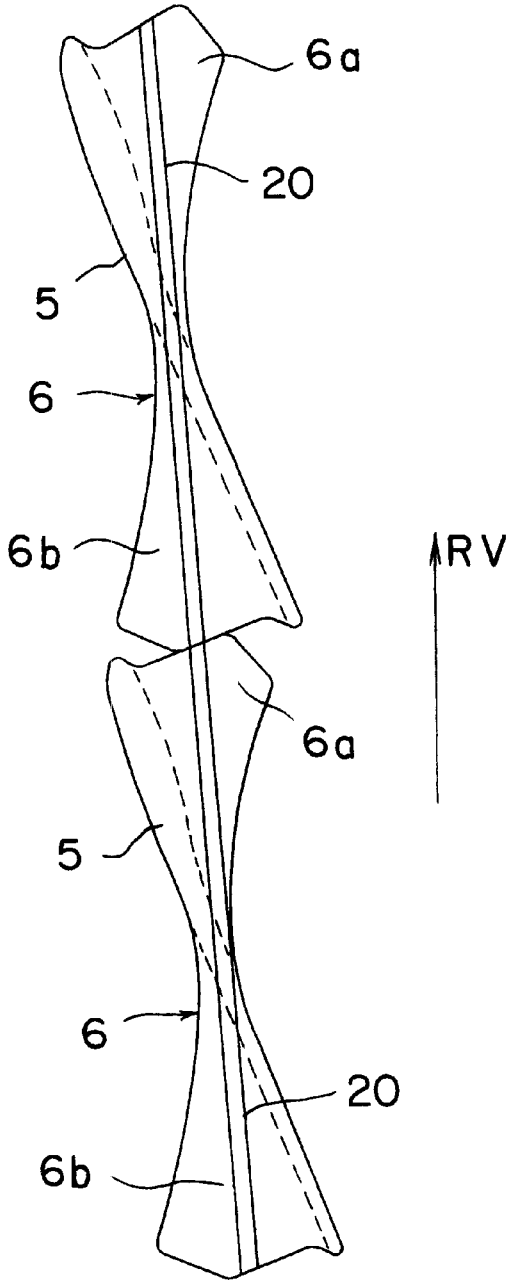
FIG. 3B is a plan view of the snubber covers attached to the moving blades of the moving turbine blade apparatus in the embodiment shown in FIG. 3A in a state when the turbine is in operation.
Figure 4:
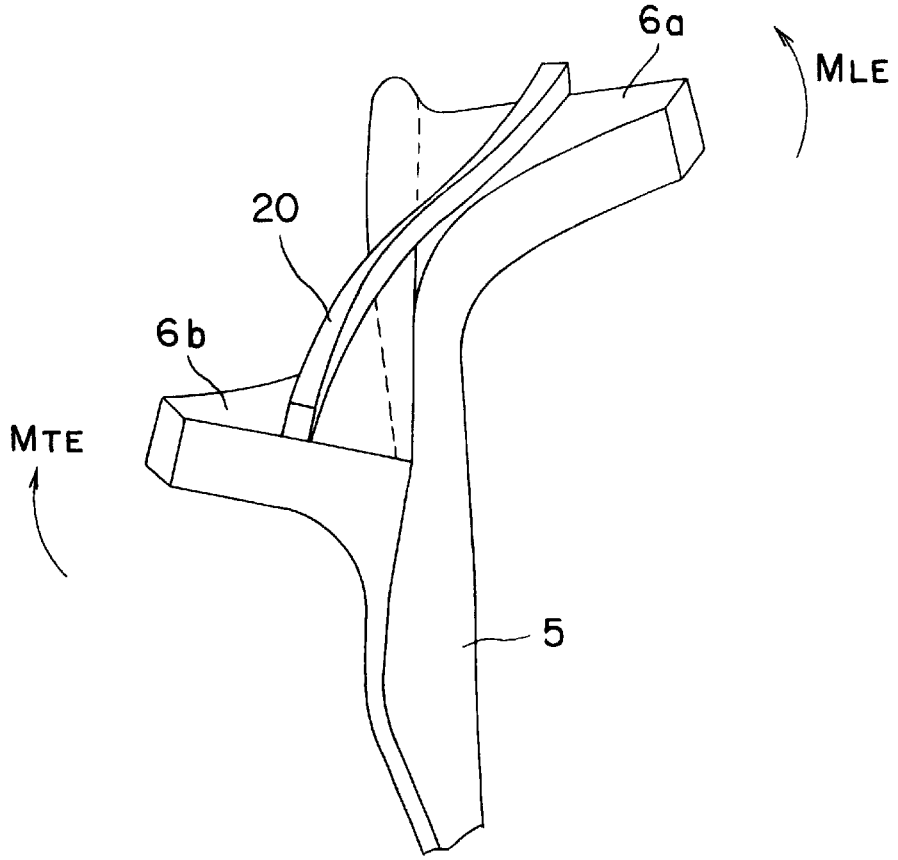
FIG. 4 is a perspective view of a moving blade with a snubber cover when bending moment is applied to a front and a rear edge portion of the snubber cover.

Referring to FIGS. 3A and 3B showing a portion of a moving turbine blade apparatus in another embodiment according to the present invention, a snubber cover 6 is formed on a moving blade 5, and a rib 20 is formed on the outer surface of a snubber cover 6 in alignment with the longitudinal center axis of the snubber cover 6. In the moving turbine blade apparatus as assembled, i.e., when the turbine is not in operation, end portions of the ribs 20 on adjacent snubber covers 6 are offset and are apart from each other in the direction of the axis of the rotor. When the turbine is in operation, the moving blades 5 are twisted and the ribs 20 of the moving blades 5 are aligned.

Thus, the end surfaces of the ribs 20 facing opposite to the flowing direction of water droplets are not exposed and the erosion of the end surfaces by water droplets can be suppressed.

Outer end portions of the moving blades 5 of the final stage, which generally are large moving blades, are formed in a small thickness to reduce stress induced therein by centrifugal force. Generally, when a snubber cover 6 is formed in such a thin outer end portion of the moving blades 5, a bending moment $M_{TE}$ indicated by the arrow in FIG. 4 acts on a rear edge portion 6*b* of the snubber cover 6 inducing an excessively high stress in the root of the snubber cover 6, and a bending moment $M_{LE}$ indicated by the arrow of a direction opposite that of the bending moment $M_{TE}$ acts on a front edge portion 6*a* of the snubber cover 6, so that the snubber cover 6 is twisted.

In the present embodiment, the ribs 20, i.e., ribs, are formed on the outer surfaces of the snubber covers 6 each having a front edge portion 6*a* and a rear edge portion 6*b* so as to extend in alignment with the longitudinal center axes of the corresponding snubber covers 6, respectively. The ribs 20 serves as reinforcing members that give the snubber covers 6 strength that resists bending to suppress the bending of the snubber covers 6. The bending moment $M_{TE}$ created by centrifugal force that acts on the rear edge portion 6*b* extending on the side of the rear surface of the moving blade 5 is counterbalanced by the bending moment $M_{LE}$ created by centrifugal force that acts on the front edge portion 6*b* extending on the side of the front surface of the moving blade 5 by the agency of the rib 20.

If the leading or the trailing edge of the moving blade 5 touches the inner circumference of the outer ring 2 of a nozzle diaphragm (FIG. 8) in a transient state in starting or stopping the turbine, an external force is exerted on the leading or the trailing edge of the moving blade 5 to promote the torsional vibration of the moving blade 5. However, in the present embodiment, the rib 20 formed on the snubber cover 6 in alignment with the longitudinal center axis of the snubber cover 6 controls torsional vibration even if the leading or the trailing edge of the moving blade 5 touches the inner circumference of the outer ring 2 of the nozzle diaphragm and, consequently, the turbine is able to continue a stable operation.

Figure 5:
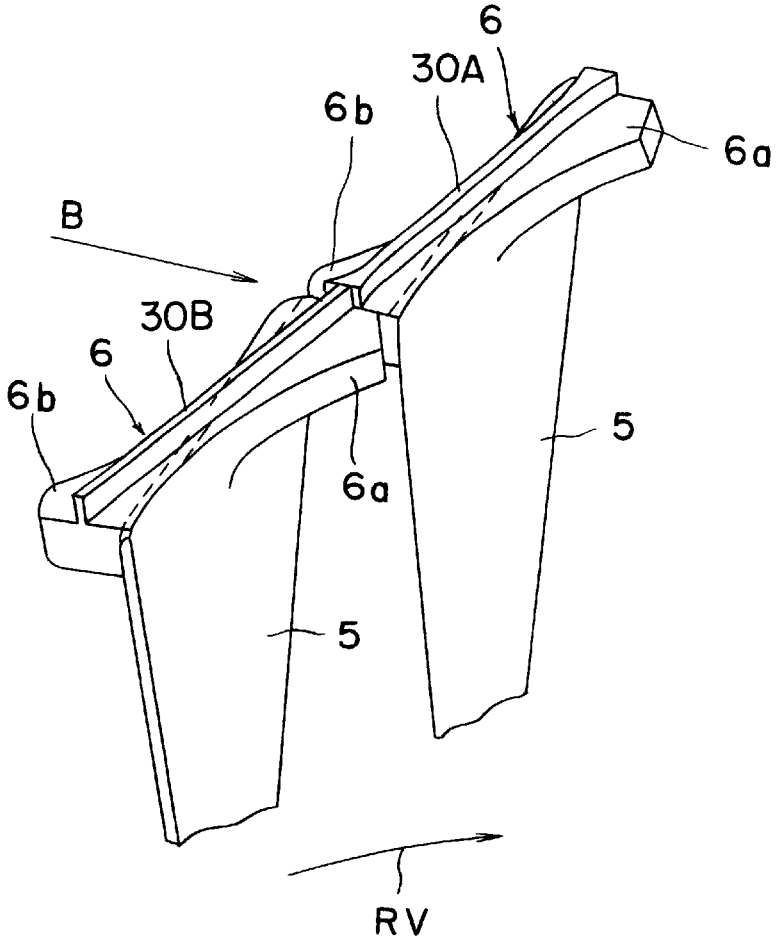
FIG. 5 is an enlarged perspective view of outer end portions of moving blades included in a moving turbine blade apparatus in another embodiment according to the present invention.

Referring to FIG. 5 showing a portion of a moving turbine blade apparatus in another embodiment according to the present invention, at least one of a pair of adjacent ribs 30A and 30B, i.e., the rib 30A in FIG. 5, has opposite end portions of a thickness measured in the direction of the axis of the rotor shaft greater than that of a middle portion thereof. The other rib 30B has a uniform thickness over the entire length thereof. The thickness of the rib 30*b* is smaller than that of the opposite end portions of the rib 30A. The ribs 30A and the ribs 30B are arranged alternately.

Since the ribs 30A each having the thick opposite end portions and the ribs 30B of a uniform thickness are arranged alternately, the corresponding end surfaces of the adjacent ribs 30A and 30B can be surely engaged when the turbine operates.

Figure 6:
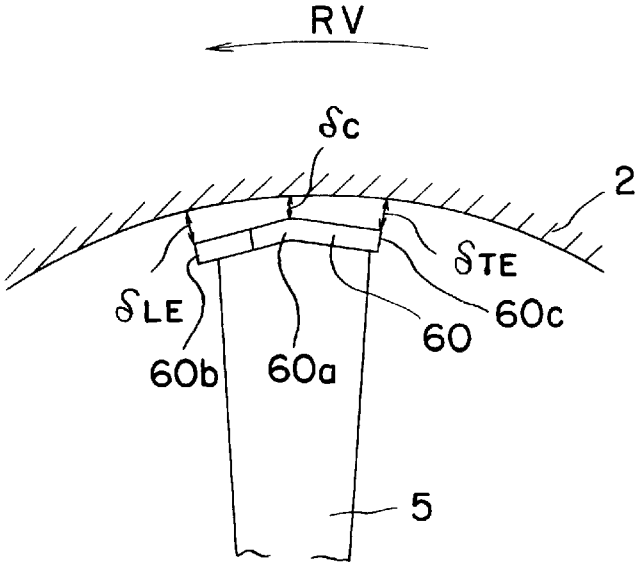
FIG. 6 is a view of an outer end portion of a moving blade included in a moving turbine blade apparatus in another embodiment according to the present invention.

Referring to FIG. 6 showing a portion of a moving turbine blade apparatus in another embodiment according to the present invention, a snubber cover 60 is formed on the outer end of a moving blade 5. A gap $\delta_{LE}$ between the a front edge portion 60*b* of the snubber cover 60 and the inner circumference of the outer ring 2 of the nozzle diaphragm, a gap $\delta_{TE}$ between the rear edge portion 60*c* of the snubber cover 60 and the inner circumference of the outer ring 2 of the nozzle diaphragm are greater than a gap $\delta_c$ between a middle portion 60*a* of the snubber cover 60 and the inner circumference of the outer ring 2 of the nozzle diaphragm. Thus, the snubber cover 60 is formed in a special shape as shown in FIG. 6 so that each of the gaps $\delta_{LE}$ and $\delta_{TE}$ are greater than the gap $\delta_c$.

Even if rubbing should occur, the exertion of an external force on the leading and the trailing edge of the moving blade 5 can be prevented and hence torsional vibration, which is a significant problem with large moving blades, is not promoted. The application of the moving turbine blade apparatus in the present embodiment to a turbine improves the efficiency of the turbine and stabilizes the operation of the turbine.

In a modification of the present embodiment, the snubber cover 60 may be provided on its outer surface with any one of the ribs of the foregoing embodiments.

Figure 7:
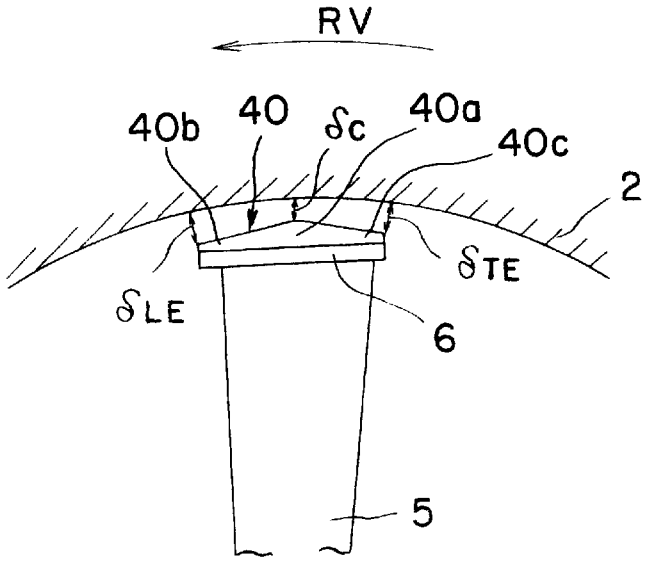
FIG. 7 is a view of an outer end portion of a moving blade included in a moving turbine blade apparatus in another embodiment according to the present invention.
Figure 8:
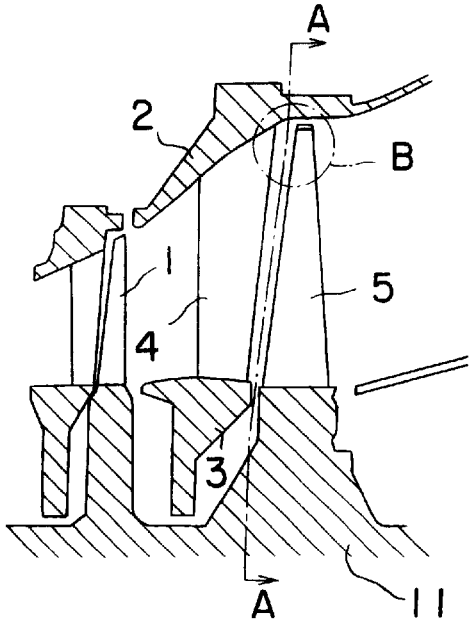
FIG. 8 is a sectional view of the final stage of a general steam turbine.
Figure 9:
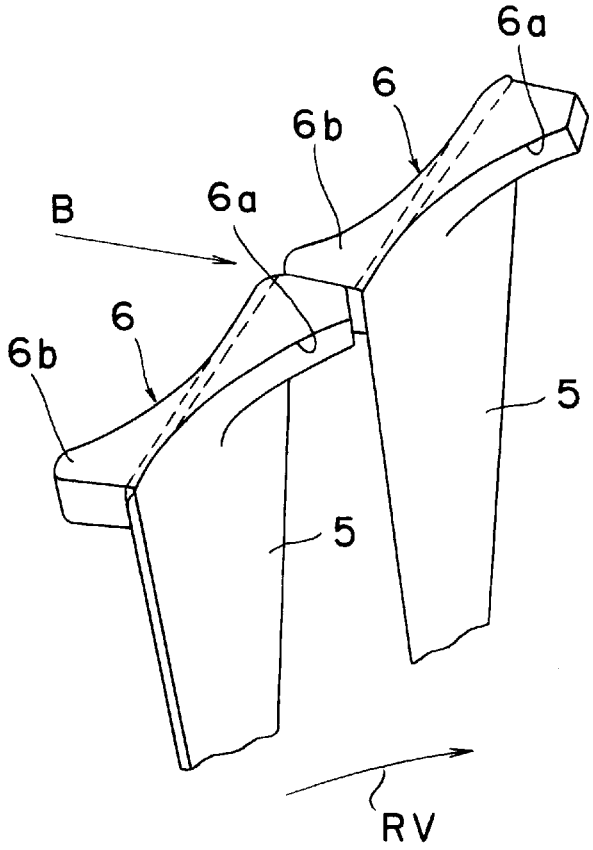
FIG. 9 is an enlarged perspective view of outer end portions of moving blades in the final stage of a general steam turbine.
Figure 10A:
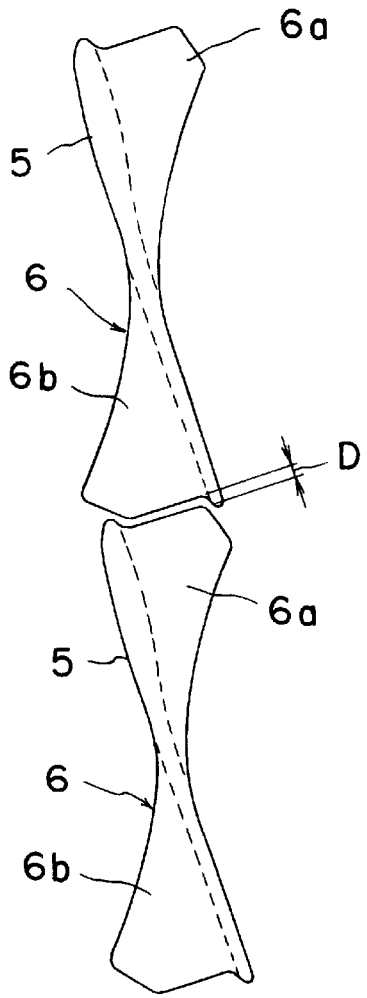
FIG. 10A is a plan view of snubber covers attached to moving blades in a general steam turbine in a state when the turbine is not in operation.
Figure 10B:
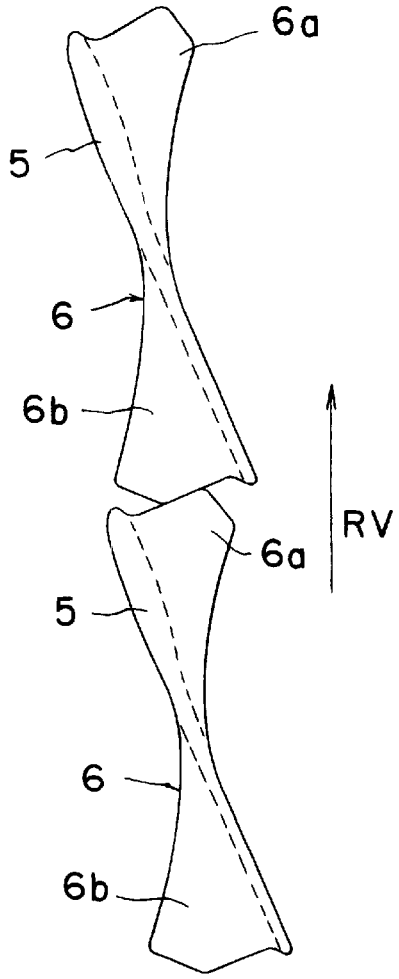
FIG. 10B is a plan view of snubber covers attached to moving blades in a general steam turbine in a state when the turbine is in operation.
Figure 11:
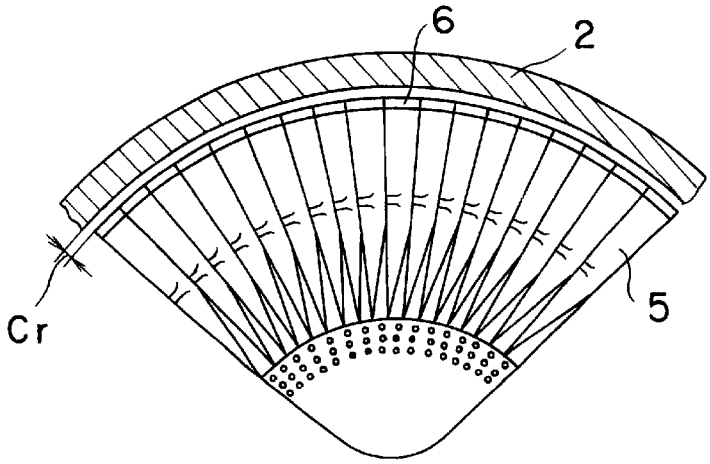
FIG. 11 is a sectional view taken on line A—A in FIG. 8.
Figure 12:
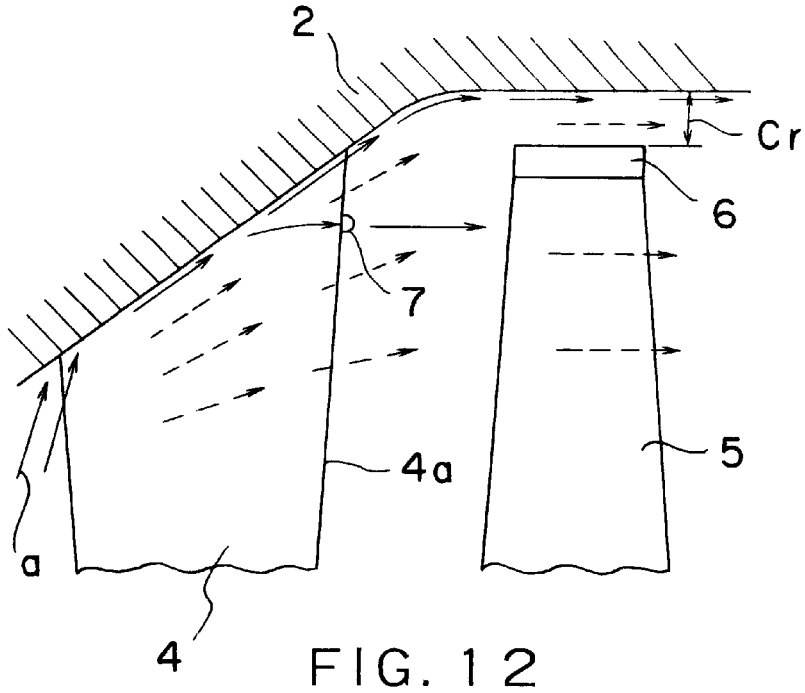
FIG. 12 is an enlarged view of a portion B in FIG. 8, showing flows of steam and water droplets.
Figure 13:
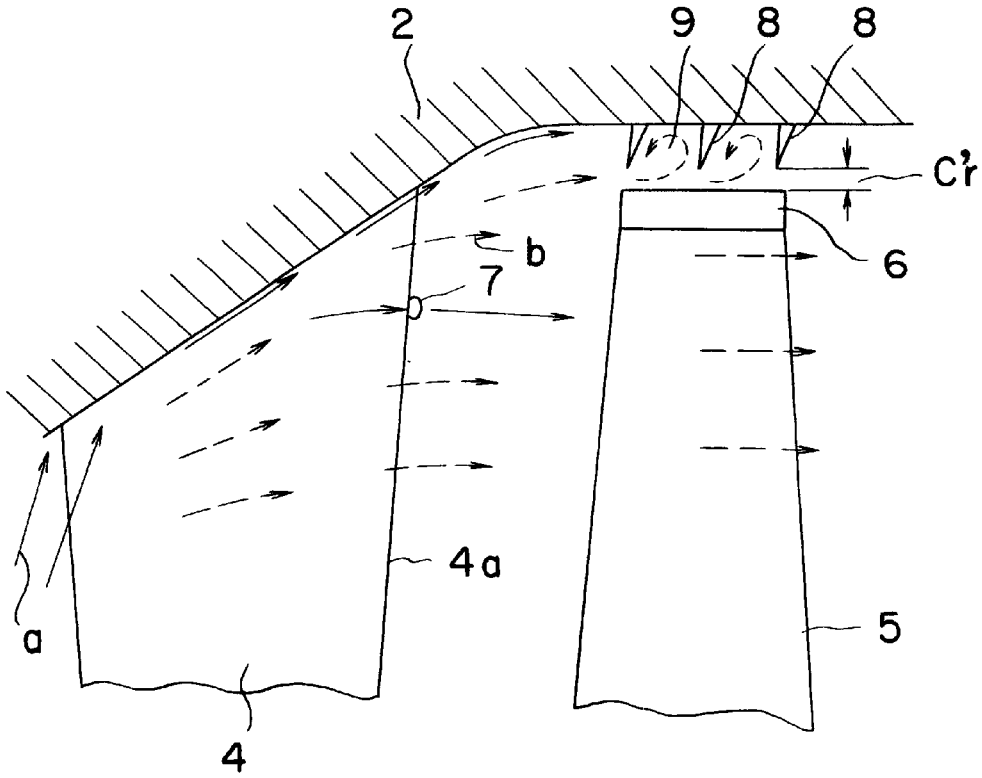
FIG. 13 is a view of an outer ring included in a nozzle diaphragm and provided on its inner circumference with ribs.

Referring to FIG. 7 showing a portion of a moving turbine blade apparatus in another embodiment according to the present invention, a snubber cover 6, which is similar to any one of the ribs of the foregoing embodiments, is provided on its outer surface with a rib 40 extending in parallel to the circumference of a rotor shaft. The respective heights of opposite end portions 40*b* and 40*c* of the rib 40 are smaller than that of a middle portion 40*a* of the same. Therefore, gaps $\delta_{LE}$ and $\delta_{TE}$ between the end portions 40*b* and 40*c*, and the inner circumference of the outer ring of the nozzle diaphragm are greater than a gap $\delta_c$ between the middle portion 40*a* and the inner circumference of the outer ring of the nozzle diaphragm.

The present embodiment exercises the same effect as the embodiment shown in FIG. 6.

What is claimed is:

1. A moving turbine blade apparatus, comprising:

a plurality of moving blades adapted to be mounted on a rotor shaft;

a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft;

wherein at least one of opposite end portions of the rib has a thickness measured in a direction of the axis of the rotor shaft greater than a thickness of middle portion of the same rib measured in the direction of the axis of the rotor shaft;

wherein the thickness of one of the opposite end portions of the rib measured in the direction of the axis of the rotor shaft is greater than a thickness of an other end portion of the same rib measured in the direction; and wherein the rib is extended in alignment with a longitudinal center axis of the snubber cover.

2. A moving turbine blade apparatus, comprising:

a plurality of moving blades adapted to be mounted on a rotor shaft;

a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft;

wherein at least one of a pair of the adjacent ribs has opposite end portions each having a thickness measured in a direction of the axis of the rotor shaft greater than a thickness of a middle portion of the same rib.

3. The moving turbine blade apparatus according to claim 2, wherein the rib is extended in alignment with a longitudinal center axis of the snubber cover.

4. A moving turbine blade apparatus comprising:

a plurality of moving blades adapted to be mounted on a rotor shaft;

a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft;

wherein the ribs of the adjacent moving blades are aligned while the turbine is in operation by centrifugal force acting on and twisting the moving blades and ends of the ribs of the adjacent moving blades are offset with each other while the turbine is not in operation.

5. The moving turbine blade apparatus according to claim 4, wherein the rib is extended in alignment with a longitudinal center axis of the snubber cover.

6. A turbine moving blade apparatus, comprising:

a plurality of moving blades adapted to be mounted on a rotor shaft;

a plurality of snubber covers formed on outer ends of the moving blades, respectively, so as to be arranged successively in a circle having its center on an axis of the rotor shaft; and a plurality of ribs projecting from outer surfaces of the snubber covers, respectively, so as to extend in a circle having its center on the axis of the rotor shaft;

wherein respective heights of opposite end portions of the rib is smaller than a height of a middle portion of the same rib.

7. The moving turbine blade apparatus according to claim 6, wherein the rib is extended in alignment with a longitudinal center axis of the snubber cover.

8. A moving turbine blade apparatus, comprising:

a plurality of moving blades adapted to be mounted on a rotor shaft; and a plurality of snubber covers formed on outer ends of the moving blades, respectively, so as to be arranged successively in a circle having its center on an axis of the rotor shaft and each having a front edge portion on a downstream side with respect to a flowing direction of a working fluid, a rear edge portion on an upstream side with respect to the flowing direction of the working fluid and a middle portion between the front edge portion and the rear edge portion;

wherein the snubber cover is formed such that a gap between an inner circumference of an outer ring of a nozzle diaphragm of the turbine and the front edge portion of the snubber cover and a gap between the inner circumference of the outer ring of the nozzle diaphragm of the turbine and the rear edge portion of the snubber cover each is greater than a gap between the inner circumference of the outer ring of the nozzle diaphragm of the turbine and the middle portion of the same snubber cover.

9. The moving turbine blade apparatus according to claim 1 further comprising a plurality of ribs projecting from outer surfaces of the snubber covers, respectively, so as to extend in a circle having its center on the axis of the rotor shaft.

* * * * *

UNITED STATES PATENT AND TRADEMARK OFFICE

CERTIFICATE OF CORRECTION

PATENT NO. : 6,402,474 B1
DATED : June 11, 2002
INVENTOR(S) : Okuno

It is certified that error appears in the above-identified patent and that said Letters Patent is hereby corrected as shown below:

Column 9,
Line 31, change “blades and” to -- blades, and --.

Signed and Sealed this

Twenty-seventh Day of August, 2002

*Attest:*

*Attesting Officer*

JAMES E. ROGAN
*Director of the United States Patent and Trademark Office*